US008794292B2

(12) United States Patent
Inokuchi et al.

(10) Patent No.: US 8,794,292 B2
(45) Date of Patent: Aug. 5, 2014

(54) DOUBLE-FACED ADHESIVE TAPE JOINING APPARATUS

(75) Inventors: Shinji Inokuchi, Ibaraki (JP); Kazuhiko Kinpara, Ibaraki (JP); Naoto Kato, Ibaraki (JP); Isao Hirose, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 252 days.

(21) Appl. No.: 13/266,537

(22) PCT Filed: Apr. 20, 2010

(86) PCT No.: PCT/JP2010/002844

§ 371 (c)(1),
(2), (4) Date: Oct. 27, 2011

(87) PCT Pub. No.: WO2010/125766

PCT Pub. Date: Nov. 4, 2010

(65) Prior Publication Data

US 2012/0055635 A1 Mar. 8, 2012

(30) Foreign Application Priority Data

May 1, 2009 (JP) ..... 2009-111963

(51) Int. Cl.
*B65H 37/02* (2006.01)
*B65H 37/04* (2006.01)
*B65H 35/08* (2006.01)

(52) U.S. Cl.
USPC ..... 156/523; 156/540; 156/577; 156/579

(58) Field of Classification Search
CPC .... B65H 3/0003; B65H 37/005; B65H 37/02; B65H 37/04; B65H 35/0033; B65H 35/08
USPC ..... 156/517, 523, 540, 555, 577, 579
See application file for complete search history.

(56) References Cited

U.S. PATENT DOCUMENTS 3,211,604 A * 10/1965 Rymer ..... 156/577
RE28,010 E * 5/1974 Way ..... 156/530

(Continued)

FOREIGN PATENT DOCUMENTS

JP 57-183940 A 11/1982
JP 1-162679 A 6/1989

(Continued)

OTHER PUBLICATIONS

Supplementary European Search Report for the Application No. EP 10 76 9468 dated Sep. 6, 2013.

(Continued)

*Primary Examiner* — Linda L Gray
(74) *Attorney, Agent, or Firm* — Cheng Law Group, PLLC

(57) ABSTRACT

Provided is double-faced adhesive tape joining apparatus that allows accurate joining of a double-faced adhesive tape on a tape joining surface of a workpiece in a curved or bent shape with no damage on a surface of a separator joined to the double-faced adhesive tape and no floating of the separator. Specifically, a hand-operable base includes a tape guide for guiding the double-faced adhesive tape successively supplied, and a joining head for pressing against the joining surface of the workpiece the double-faced adhesive tape supplied to a front end of the base. The base and the joining head are configured as to rotate relatively about a support axis toward a longitudinal tape direction.

15 Claims, 8 Drawing Sheets

(56) References Cited

U.S. PATENT DOCUMENTS

| | | | |
|---|---|---|---|
| 3,969,180 | A | 7/1976 | Ravesloot |
| 4,453,999 | A | 6/1984 | Holland-Letz |
| 5,192,385 | A | 3/1993 | Moll |
| 6,273,169 | B1 | 8/2001 | Ono et al. |
| 7,299,845 | B2 | 11/2007 | Morimoto et al. |

FOREIGN PATENT DOCUMENTS

| | | | | | |
|---|---|---|---|---|---|
| JP | 5-51694 | U | | 7/1993 | |
| JP | 5-51852 | U | | 7/1993 | |
| JP | H5-51852 | U | * | 7/1993 | ..... B65H 35/07 |
| JP | 7-21748 | U | | 4/1995 | |
| JP | 8-290699 | A | | 11/1996 | |
| JP | 11-170770 | A | | 6/1999 | |
| JP | 11-227385 | A | | 8/1999 | |
| JP | 2005-35724 | A | | 2/2005 | |
| WO | WO-01/62648 | | | 8/2001 | |
| WO | WO0162648 | A1 | * | 8/2001 | ..... B65H 37/00 |

OTHER PUBLICATIONS

International Search Report for the Application No. PCT/JP2010/002844 mailed Jun. 8, 2010.

Notification of Reasons for Refusal for the Application No. 2009-111963 from Japan Patent Office mailed Oct. 30, 2012.

The First Office Action for Application No. 201080019249.7 from the State Intellectual Property Office of the People's Republic of China dated Nov. 13, 2013.

* cited by examiner

DOUBLE-FACED ADHESIVE TAPE JOINING APPARATUS

CROSS REFERENCE TO RELATED APPLICATIONS

The present application is a 371 application of PCT/JP2010/002844, filed Apr. 20, 2010, which is based on Japanese Patent Application No. 2009-111963 filed on May 1, 2009, the entire contents of which are hereby incorporated by reference into the present application.

TECHNICAL FIELD

This invention relates to double-faced adhesive tape apparatus for joining a double-faced adhesive tape successively to a front face of a workpiece.

BACKGROUND ART

The following method is known for joining an adhesive tape successively to a front face of a workpiece. For instance, an adhesive tape with a separator is guided to hand-held joining apparatus, and an adhesive face thereof is exposed while the separator is separated. Then, the apparatus is moved while the adhesive face is pressed against a given joining face. Accordingly, the adhesive tape is successively joined to the workpiece (see Patent Literature 1.)

[Patent Literature 1]

Japanese Patent Publication No. 2005-35724

DISCLOSURE OF THE INVENTION

Problem to be Solved by the Invention

It is also possible to join a double-faced adhesive tape with the same manner as above. However, the following problem may arise.

When a double-faced adhesive tape is joined to a joining surface of a workpiece, a joining portion at a front end of the joining apparatus is kept parallel to the joining surface, whereby the double-faced adhesive tape may be joined applying a uniform pressure in a width direction thereof. On the other hand, when a joining course is curved or bent, the joining portion at the front end of the joining apparatus need to be parallel to the joining surface through turning of a wrist with which the joining apparatus is held. Herein, where a curved joining course and a linear joining course exist, the wrist need to be turned frequently. Accordingly, an operator tends to be tired easily. In particular, a serpentine joining course requires forward/backward turn of the wrist, which leads to increased tendency for an operator to be tired.

Moreover, a separator remaining on the surface of the adhesive tape may possibly be separated and float inadvertently upon transportation of the workpiece having the adhesive tape joined thereto. Herein, the exposed adhesive face may possibly be degraded on exposure to air. Moreover, contamination may possibly adhere to an adhesive face, and adhesive performance thereof may be reduced. Consequently, the separator on the surface of the double-faced adhesive tape joined to the workpiece needs not to be separated and float up inadvertently.

When the double-faced adhesive tape is joined along a linear course or a loose curved course having approximately a straight line on the front face of the workpiece, the separator on the joined surface of the double-faced adhesive tape is not separated and floats up inadvertently. On the other hand, where the adhesive tape with a separator is joined on a curved course slightly bent or having a small curvature, a less elasticity of the separator than the body of the double-faced adhesive tape may cause "float" or wrinkles of the separator due to a restoring force of the separator.

Specifically, a material with smaller elasticity than an adhesive tape body, e.g., a resin tape of low adhesive property capable of ready separation from an adhesive face of an adhesive tape and a paper material to which resin coating is performed, is adopted for the separator. Accordingly, when the double-faced adhesive tape on a course having a small curvature is joined compressed in a course direction inside of a curved portion. On the other hand, the double-faced adhesive tape outside of the curved portion is joined while expanding in the tape joining direction. Herein, the separator inside of the curved portion where compression occurs has some wrinkles only, and is not separated greatly from the adhesive face. However, the separator outside of the curved portion where expansion occurs cannot follow expansion of the double-faced adhesive tape. Accordingly, the separator may readily be separated from the adhesive face. Moreover, separation outside of the curved portion expands toward a periphery thereof, and the separator is separated and floats up in a large range of the curved portion.

Moreover, the apparatus serpentinely travels along a curved shape, a joining roller at the front end cannot follow lateral rotation in the tape width direction. Accordingly, the joining roller is not parallel to the joining surface of the workpiece, and thus contacts to the joining surface on one side. As a result, there arises a problem that an edge of the joining roller presses and damages a surface of a separator on the double-faced adhesive tape.

This invention has been made regarding the state of the art noted above, and its primary object is to provide double-faced adhesive tape joining apparatus that allows successive joining of a double-faced adhesive tape on a curved course smoothly with a little fatigue and suitably while a uniform pressure is applied with no separator separated therefrom.

Means for Solving the Problem

This invention is configured as under to achieve the above object. That is, this invention relates to double-faced adhesive tape joining apparatus for joining to a joining face of a workpiece a double-faced adhesive tape having one adhesive face exposed and the other adhesive tape to which a separator is joined. The apparatus includes a hand-operable base, a tape guide device, a joining head. The tape guide device guides the double-faced adhesive tape that is successively supplied to the base. The joining head presses against the joining surface of the workpiece the double-faced adhesive tape guided to a front end of the base. The base and the joining head are configured as to relatively rotate about a support shaft along a longitudinal tape direction.

The front end of the double-faced adhesive tape T having an expose adhesive face is joined to a joining start position in the joining face of a workpiece. Thereafter, the double-faced adhesive tape joining apparatus held with one hand is moved backward relative to the workpiece. Here, lateral attitude in the tape width direction varies, whereby the double-faced adhesive tape pressed with the joining head is joined along any joining course.

Specifically, on the curved joining course, the apparatus may be entirely changed in travel direction without largely turning the wrist through lateral inclination of the base held. In this case, even when the base is laterally inclined, the joining head relatively rotates and may be kept parallel to the joining face of the workpiece. Consequently, the edge of the joining head does not contact on one side, and thus the double-faced adhesive tape may be pressed and joined uniformly in the width direction. As a result, no damage occurs on the separator on the surface.

The foregoing configuration preferably includes an elastic bias device for elastically holding a relative rotation attitude of the base and the joining head.

According to this configuration, lateral inclination of the held base on the curved joining course may realize maintaining of an attitude of the entire apparatus in a traveling direction without largely turning the wrist. Moreover, when a lateral inclination force applied to the base is released, an elastic restoring force is generated to move the base relative to the joining head and return to its original attitude. Accordingly, a joining attitude of the double-faced adhesive tape may readily vary relative to the linear or curved course, which results in joining of the double-faced adhesive tape to the workpiece with uniform pressure regardless of shapes of the tape joining course.

The base of the foregoing configuration preferably includes a tape cutting mechanism for forming slits on sides of the separator at given intervals along a longitudinal tape direction.

With this configuration, the slits may be formed on sides of the separator at given intervals along the longitudinal tape direction on the curved joining course. Consequently, there may be suppressed inadvertent separation and floating of the separator with poor elasticity from the adhesive tape body due to tension over a large range in a longitudinal tape direction.

The tape cutting mechanism in the foregoing configuration preferably includes an arm, a rotary cutter, and a holding roller. The arm is pivotally connected to the base as to swing downward. The rotary cutter operates from a separator side of the double-faced adhesive tape. The holding roller holds the double-faced adhesive tape from an adhesive face side thereof.

According to this configuration, the double-faced adhesive tape travels while being interposed between the rotary cutter and a holding roller. Accordingly, slits may be formed successively on the sides of the separator accurately at given pitches.

It is preferable that the tape cutting mechanism of this invention may switch back and forth between an operating condition where the rotary cutter and the holding roller are placed close to form a slit on sides of the separator of the double-faced adhesive tape passing between the rotary cutter and the holding roller and a non-operating condition where the rotary cutter is spaced away from the holding roller and the double-faced adhesive tape travels while no slit is formed.

According to this invention, when both the linear joining course and the curved joining course exist, the slits may be formed only on the curved joining course where the separator may possibly be separated. Thus, formation of an unnecessary slit may be avoided on the linear joining course where the separation is not possibly separated, which results in simple joining operation as well as reduction in early wear of the rotary cutter.

In the above, an elastic body is preferably provided for swingingly biasing the arm upward relative to the base.

This configuration preferably includes a holding mechanism for fixedly holding the arm on the base such that the rotary cutter at the lower portion of the arm is fixed in an operation position when the arm moves downward against swinging bias.

According to this configuration, when the curved joining course is long, an operator may concentrate on an operation of following the long curved joining course without continuously applying a force. Consequently, smooth joining may be conducted under constant pressure, which results in enhanced adhesion of the double-faced adhesive tape to the workpiece.

Moreover, the joining head of this configuration may be a roller supported on the front end of the base as to freely rotate. Alternatively, the joining head may include a tape joining groove at the planar front end of the base having a smaller thickness and a larger width than the double-faced adhesive tape.

Effect of the Invention

As noted above, with the double-faced adhesive tape joining apparatus according to this invention, the double-faced adhesive tape may be smoothly joined successively with a little fatigue even on the curved or bent joining course. Moreover, the joining head rotates laterally in the tape width direction. Accordingly, there is no possibility that the edge of the roller provided in the joining head contacts on one side. Consequently, damages on the separator may be suppressed due to deviation in pressure. Moreover, the double-faced adhesive tape may be accurately joined on the curved or bent course with no separator separated therefrom.

DESCRIPTION OF REFERENCES

2 . . . base
4 . . . joining head
5 . . . tape cutting mechanism
22 . . . rotary cutter
24 . . . holding roller
T double-faced adhesive tape
k . . . slit
s1 . . . separator
s2 . . . separator
W . . . workpiece

[BEST MODE FOR CARRYING OUT THE INVENTION]

One embodiment of this invention is now to be described below with reference to the drawings.

Figure 1:
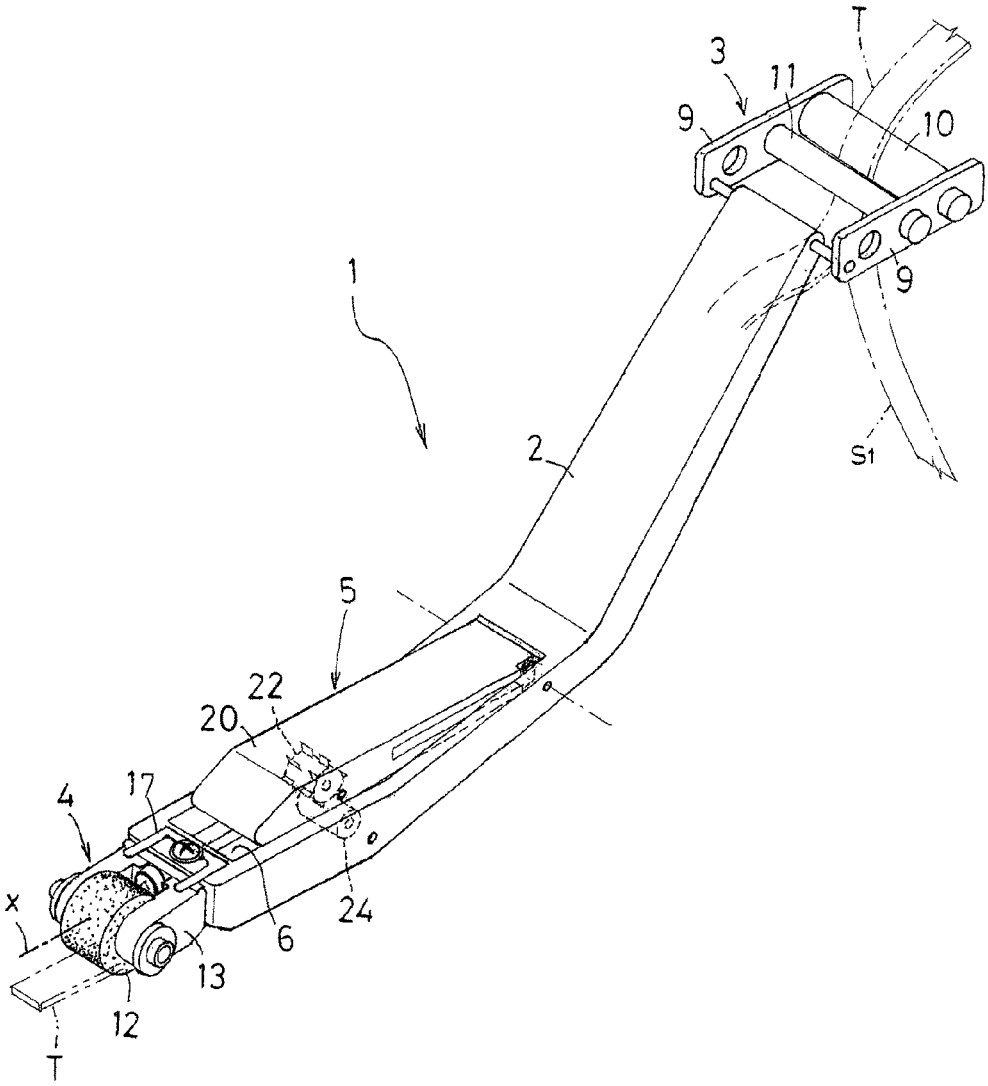
FIG. 1 is a perspective view of double-faced adhesive tape joining apparatus.
Figure 2:
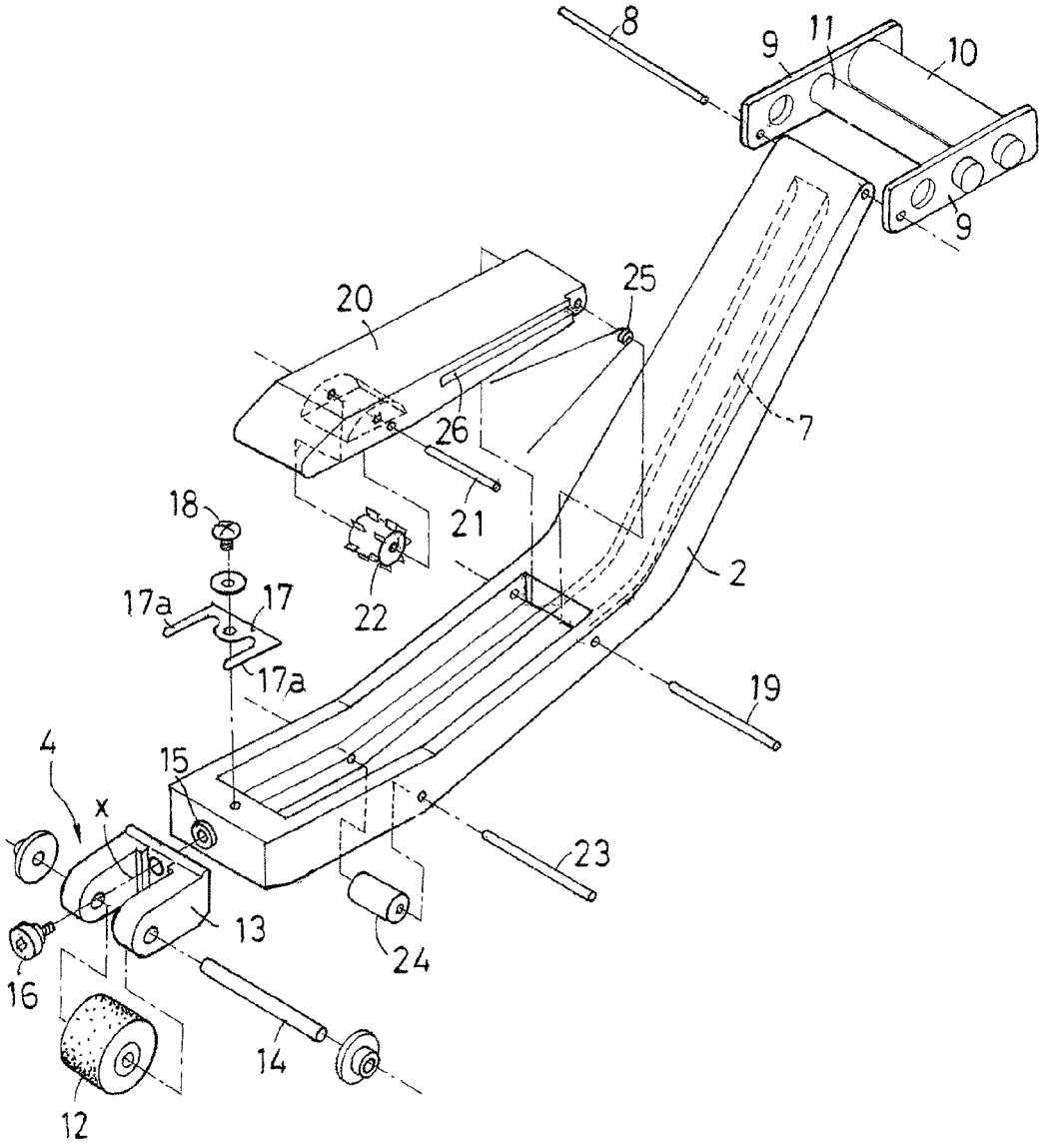
FIG. 2 is an exploded perspective view of the double-faced adhesive tape joining apparatus.
Figure 3:
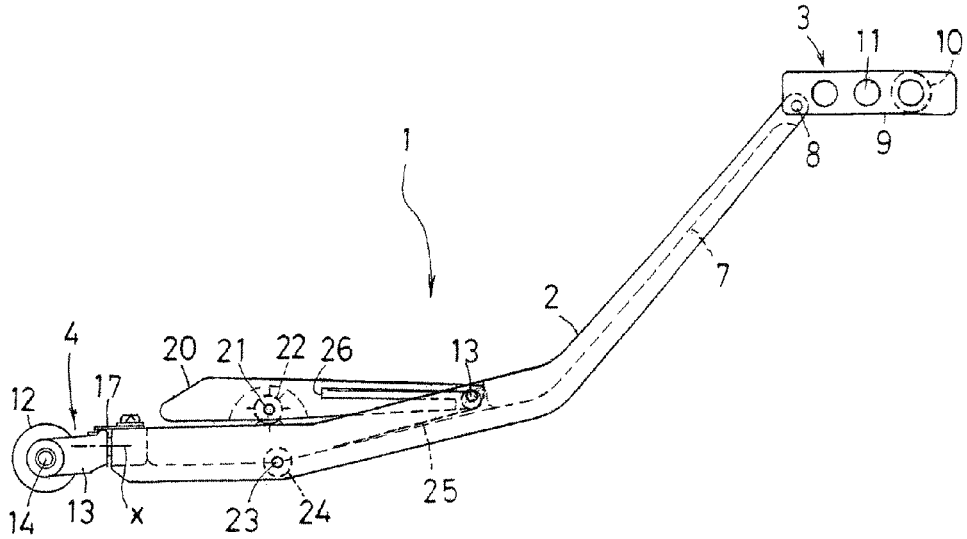
FIG. 3 is a side view of the double-faced adhesive tape joining apparatus.
Figure 4:
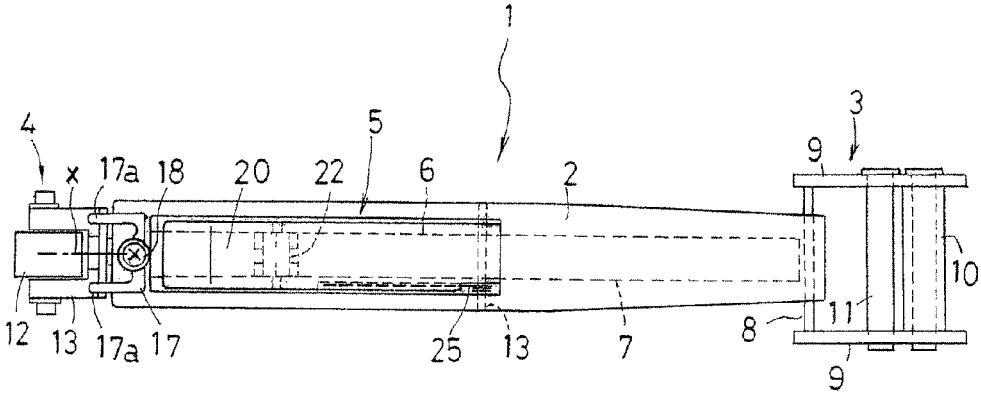
FIG. 4 is a plan view of the double-faced adhesive tape joining apparatus.
Figure 11:
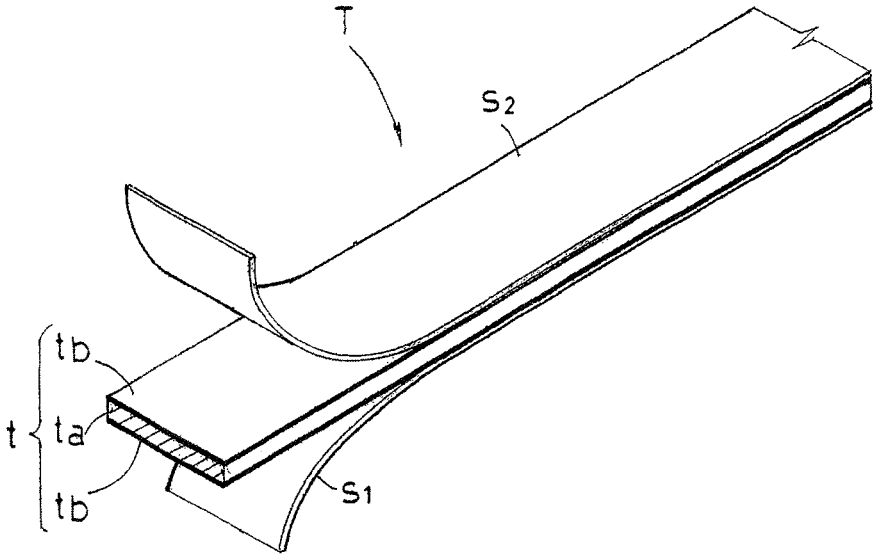
FIG. 11 is a partial perspective view of a double-faced adhesive tape.

FIGS. 1 to 7 are each one example of double-faced adhesive tape joining apparatus according to this invention. FIG. 1 is a perspective view of a general configuration of the apparatus. FIG. 2 is an exploded perspective view thereof. FIG. 3 is a side view thereof. FIG. 4 is a plan view thereof A double-faced adhesive tape T adopted in this embodiment is formed as shown in FIG. 11, for example, through joining and holding separators s1 and s2, respectively, onto upper and lower surfaces of an adhesive tape body t. The adhesive tape body t has adhesive layers tb on upper and lower surfaces of a base material ta of a several millimeters width that is composed of a foamed resin material elastically deformable.

Such as a base material with a separation layer, a base material of a low adhesive property composed of fluorine-based polymer, a base material of a low adhesive property composed of non-polar polymer may be adopted for the separators s1, s2. For the base material with the separation layer, a plastic film or a paper material is for example adopted to which a release coating, such as a silicone release coating, a long-chain alkyl based release coating, a fluorine based release coating, and a molybdenum sulfide, is applied. Moreover, for the fluorine-based polymer, such as polytetrafluoroethylene, polychlorotrifluoroethylene, polyvinyl fluoride, polyvinylidene fluoride, a tetrafluoroethylene hexafluoropropylene copolymer, and a chlorofluoroethylene-vinylidene fluoride copolymer is adopted. Moreover, for the non-polar polymer, an olefin-based resin, such as polyethylene and polypropylene, is adopted.

The double-faced adhesive tape joining apparatus 1 is configured such that an operator may hold it for use with one hand. As shown in FIG. 1, the double-faced adhesive tape joining apparatus 1 is bent into an inverted L-shape, and includes a base 2 that allows holding with one hand, a tape guide 3 provided at a rear end of the base 2, a joining head 4 provided at a front end of the base 2, and a tape cutting mechanism 5 provided at a front half section of the base 2.

The base 2 is formed of a hard resin material having superior smoothness. As shown in FIGS. 1 to 4, the base 2 has an opening 6 at the front half section in an approximately horizontal attitude that is formed in a forward/backward direction as to open vertically. The opening 6 has the tape cutting mechanism 5 incorporated therein. A tape guide groove 7 is formed in a forward/backward direction on a lower surface of a rear half section of the base 2 inclined obliquely upward toward the rear side, and one end of the tape guide groove 7 is communicated with the opening 6.

Figure 7:
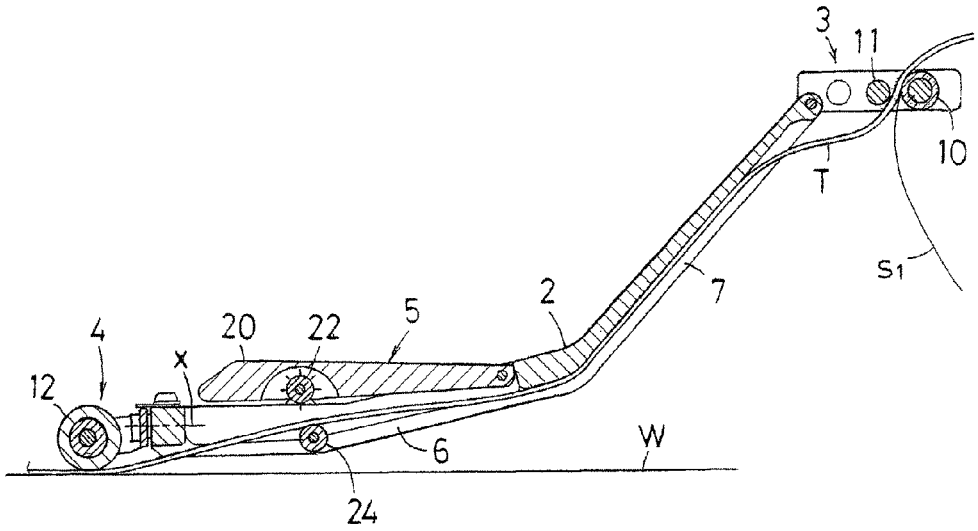
FIG. 7 is a vertical sectional side view showing a joining operation where no slit is formed in a separator.
Figure 8:
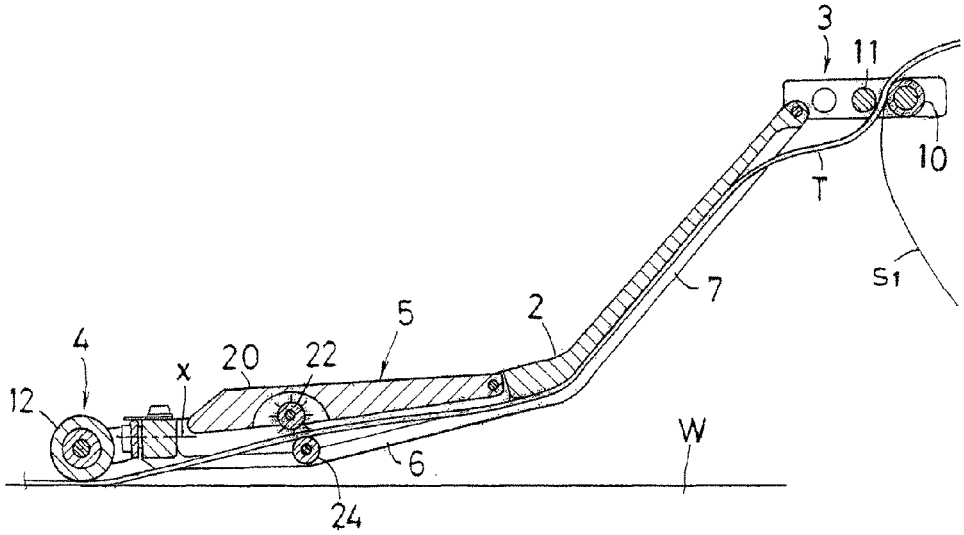
FIG. 8 is a vertical sectional side view showing a joining operation where slits are formed in a separator.
Figure 9:
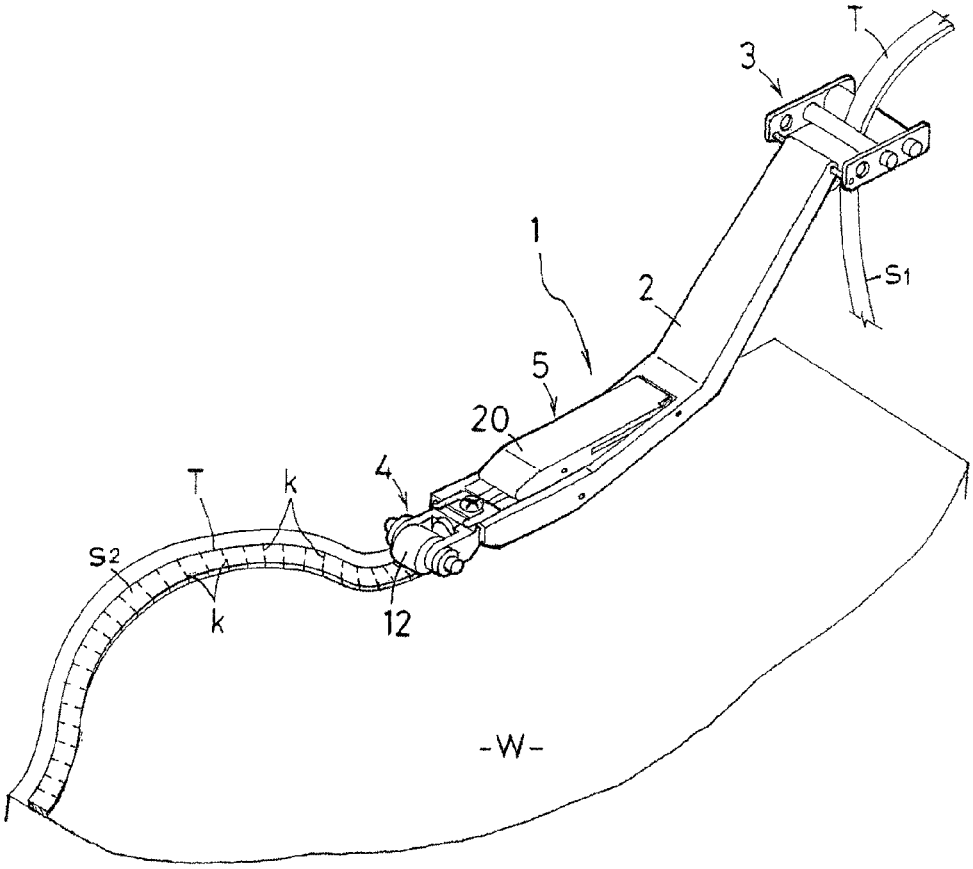
FIG. 9 is a perspective view showing a joining operation.

The tape guide 3 includes a pair of right and left brackets 9, a guide roller 10 and a guide pin 11 each supported across both brackets 9, the brackets 9 being pivotally connected to the rear end of the base 2 via a support shaft 8 as to swing upward and downward. Moreover, as shown in FIGS. 7 to 9, the tape guide 3 guides the double-faced adhesive tape T with a separator that is fed out from a tape supply section, not shown, as to feed the tape T from upward between the guide roller 10 and the guide pin 11 and as to wind and guide the tape T downward. A separator s1 on the lower surface of the tape is to be separated in this winding region. The double-faced adhesive tape T has an exposed adhesive face directed downward through separation of the separator s1, and is guided via the tape guide groove 7 to a lower portion of the base 2, and is supplied under the joining head 4. The tape guide 3 corresponds to the tape guide device in this invention.

Figure 5:
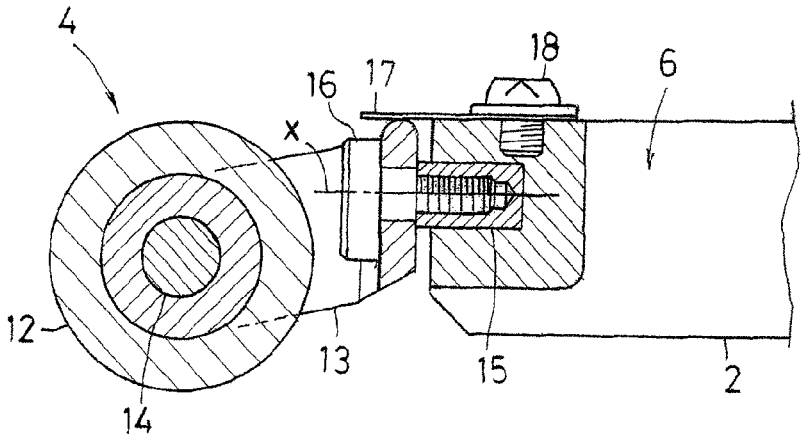
FIG. 5 is a vertical sectional side view of a joining head.
Figure 6:
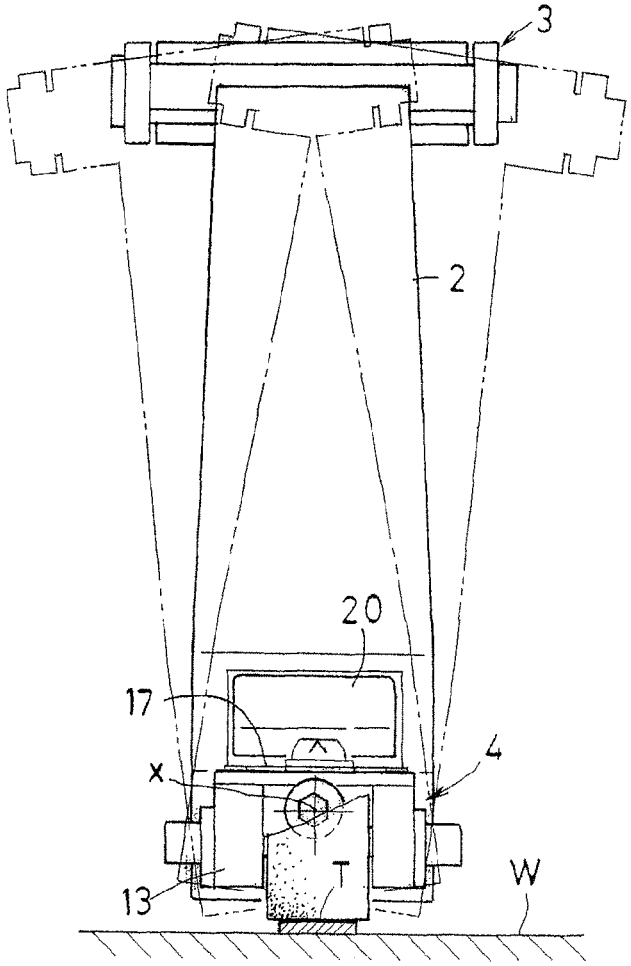
FIG. 6 is a front view of the double-faced adhesive tape joining apparatus.

As shown in FIGS. 1 and 2, the joining head 4 has a joining roller 12 formed of an elastic roller wider than the double-faced adhesive tape T that is pivotably supported horizontally on a bracket 13 via a support shaft 14 as to freely rotate. Moreover, as shown in FIG. 5, the joining head 4 has the bracket 13 pivotably rotate via a support screw 16 screwed into a boss 15 embedded into a front end surface of the base 2. Moreover, as shown in FIG. 6, the base 2 and the joining head 4 are configured to relatively rotate about a support shaft x toward a longitudinal tape direction (a rear side in figures.)

As shown in FIGS. 2, 4, and 5, the base 2 has at its front end surface a plate spring piece 17 fixedly connected thereto via a screw 18. Right and left arms 17*a* extending forward from the plate spring piece 17 contact an upper end of the bracket 13 on right and left sides of the support shaft x. Accordingly, contact and support operation of both arms 17*a* may realize elastic holding of the joining head 4 as to rotate uniformly about the support shaft x relative to the base 2. Herein, the plate spring piece 17 corresponds to the elastic bias device.

As shown in FIG. 2, the tape cutting mechanism 5 includes an operation arm 20, a rotary cutter 22, and a holding roller 24. The operation arm 20 is pivotally connected adjacent to the rear end of the opening 6 via a support shaft 19 as to swing upward and downward. The rotary cutter 22 is pivotally supported on a support shaft 21 on a lower portion in the middle of the operation arm 20 as to freely rotate. The holding roller 24 is pivotally supported on the base 2 via a support shaft 23 as to freely rotate. Here, the operation arm 20 corresponds to the arm in this invention.

The support shaft 19 is inserted into a torsion spring 25 from outside. One end of the torsion spring 25 is fitted into a groove 26 formed in a side surface of the operation arm 20, and the other end fitted into a step formed inside of the opening 6. An elastic restoring force of the torsion spring 25 biases the operation arm 20 to swing upward. Here, after one end of the torsion spring 25 is fitted into the groove 26, a resin or a block is enclosed in the groove 26 for preventing the torsion spring 25 from being detached.

Figure 10:
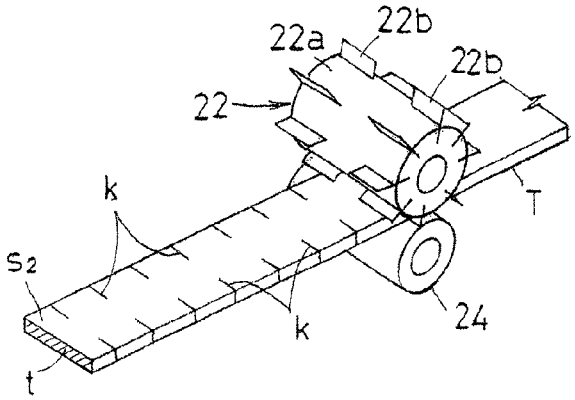
FIG. 10 is an enlarged perspective view of tape slits.

As shown in FIG. 10, the rotary cutter 22 has two or more cutter blades 22*b* embedded radially in a circumference direction at equal pitches on opposite ends of a resin roller 22*a* along the support shaft. The rotary cutter 22 is held apart upward from the holding roller 24 in a non-operation position under a free state where no external force pressing downward is applied to the operation arm 20. Moreover, when an external force pressing downward is applied to the operation aim 20, the operation arm 20 swings downward, whereby the rotary cutter 22 moves into a tape cutting position adjacent to the holding roller 24.

The holding roller 24 holds and guides the double-faced adhesive tape T that is guided under the base 2. The holding roller 24 is formed of an adhesion-resistant resin roller for smoothly guiding and traveling the double-faced adhesive tape T having an adhesive face directed downward from which the separator s1 is separated. The holding roller 24 also serves as a tape holder of the rotary cutter 22. Accordingly, a position of the holding roller 24 is set as to face to the rotary cutter 22 from downward.

The double-faced adhesive tape joining apparatus 1 according to this invention is configured as described above. Next, description will be given of a joining operation with use of the double-faced adhesive tape joining apparatus.

The front end of the double-faced adhesive tape T having an exposed adhesive face directed downward is joined to a joining start position in the joining face of a workpiece W. Thereafter, as shown in FIG. 9, the double-faced adhesive tape joining apparatus 1 held with one hand is moved backward relative to the workpiece W. Here, the double-faced adhesive tape joining apparatus is changed in lateral attitude, and the double-faced adhesive tape T pressed with the joining roller 12 is joined along any joining course.

Herein, as shown in FIG. 7, the rotary cutter 22 is held in a non-operation position on an upper side on the linear joining course. Whereas, as shown in FIG. 8, the operation arm 20 is pressed with a finger of the hand holding the base 2 on the curved joining course for moving downward the rotary cutter 22 into the tape cutting position and sandwiching the double-faced adhesive tape T between the holding roller 24 and the rotary cutter 22. Such sandwiching causes the cutter blade 22*b* of the rotary cutter 22 to engage the double-faced adhesive tape T from upside, whereby slits k are formed at given pitches along the longitudinal tape direction as to intersect both sides of the double-faced adhesive tape T. Herein, only the separator s2 on the upper surface of the tape may be cut or slits k may be formed over the separator s2 and the adhesive tape body t depending on pressure of the rotary cutter 22.

As noted above, the slits k are formed at given pitches on the sides of the separator s2 in the longitudinal tape direction on the curved joining course. Accordingly, the slits k formed are appropriately open outside of the curved portion where the double-faced adhesive tape T expands. Consequently, there may be suppressed inadvertent separation and floating of the separator s2 with poor elasticity from the adhesive tape body t due to tension over a large range in a longitudinal tape direction.

Moreover, lateral inclination of the held base 2 on the curved joining course may realize maintaining of an attitude of the entire apparatus in a traveling direction without largely turning the wrist. Herein, as shown in FIG. 6, even when the base 2 is inclined laterally, the joining head 4 rotates relatively about the support shaft x while elastically deforming one arm 17*a* of the plate spring piece 17. Accordingly, the joining head 4 may join and press uniformly the double-faced adhesive tape T in the width direction while being maintained parallel to the joining face of the workpiece W. Consequently, no damage such as a flaw with the roller edge occurs on the surface of the separator.

Moreover, when a lateral inclination force applied to the base 2 is released, an elastic restoring force of the plate spring piece 17 is generated to move the base 2 relative to the joining head 4 and return to its original attitude.

This invention may be embodied as the following aspects.

Figure 12:
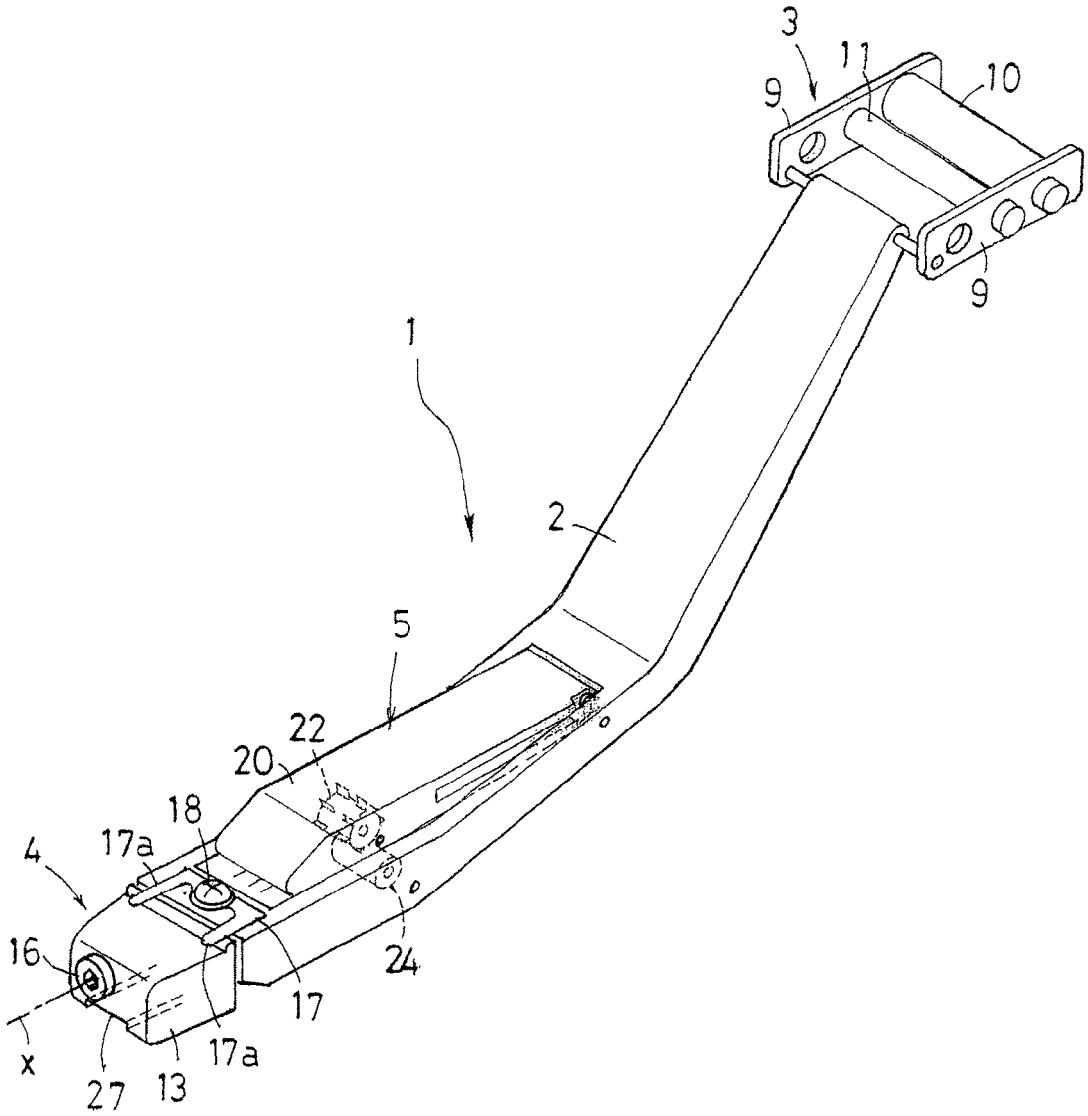
FIG. 12 is a perspective view showing double-faced adhesive tape joining apparatus according to another embodiment.

(1) As shown in FIG. 12, the joining head 4 in the foregoing embodiments may be configured having no joining roller 12. Specifically, a portion corresponding to the bracket 13 in the foregoing embodiments are formed in a block shape, and a tape guide groove 27 having a smaller depth than the thickness of the double-faced adhesive tape T is formed on a planar lower surface of the block. Such configuration may be implemented. Herein, the block provided with the bracket 13 corresponds to the joining block in this invention.

(2) The slits k on opposite ends of the double-faced adhesive tape T may be formed as under other than those in a linear shape.

For instance, the slits k may be formed to be cut alternately on both sides of the tape. Alternatively, a slit like a V-shaped notch may be formed that is tapered from the side toward a center in the longitudinal direction. Herein, the rotary cutter 22 has cutter blades 22*b* in a V-shape embedded on both ends thereof.

(3) In the foregoing embodiments, the slits k are formed on both sides of the double-faced adhesive tape T. Where joining is performed on the joining course curved or bent in one direction, slits k may be formed only on the tape side outside of the curved portion where the tape expands. In other words, the rotary cutter 22 may include cutter blades 22*b* formed on only one end thereof.

(4) In the foregoing embodiments, the rotary cutter 22 switches to a tape cutting position through continuous pressing of the operation arm 20 with the hand or finger. Alternatively, the operation arm 20 may be fixedly held with a detent mechanism appropriately in a lower swinging position.

For instance, such as a metal ball is biased that a front portion thereof projects from at least one side surface of the front end of the operation arm 20, and a recess facing and engaging the ball is formed in a position in a base body.

According to this configuration, when the curved joining course is long, an operator may concentrate on an operation of following the long curved joining course without continuously applying a force to the hand or finger. Consequently, smooth joining may be conducted under constant pressure, which results in enhanced adhesion of the double-faced adhesive tape T to the workpiece W. Here, the detent mechanism corresponds to the holding mechanism of this invention.

(5) The double-faced adhesive tape T may be adopted that has separators s1, s2 on both faces of the adhesive tape body t composed of adhesive only.

(6) The foregoing embodiment discloses the case where the double-faced adhesive tape T having the separators s1 and s2 joined on both surfaces thereof is supplied and joined to the workpiece W while one separator s1 is separated and removed in the tape guide 3. Alternatively, such aspect may be embodied to supply the adhesive tape T from which one separator s1 is separated in advance during another process or the double-faced adhesive tape T in a roll form having the separator s2 joined to one face thereof.

(7) The foregoing embodiments disclose performance of joining the tape manually through holding by an operator. Alternatively, joining of the tape may be performed automatically through attachment to a robot hand. In this case, an actuator may appropriately switch positions of the rotary cutter 22 in accordance with programs inputted in advance.

(8) In each of the foregoing embodiments, the base 2 may be formed separately along a central axis in the longitudinal direction (a tape guidance direction), and the attachment is interposed in a middle portion between separated sections. In addition, the operation arm 20, the joining head 4, the rotary cutter 22, and the holding roller 24 may be modified as to have an adopted width of the attachment.

With to this configuration, setting of the apparatus may be modified in accordance with the width of the double-faced adhesive tape T.

[Industrial Utility]

As described above, this invention is suitable for joining a double-faced adhesive tape with a separator to a curved or bent workpiece.

The invention claimed is:

1. A double-faced adhesive tape joining apparatus for joining to a joining face of a workpiece a double-faced adhesive tape having one adhesive face exposed and an other adhesive face to which a separator is joined, comprising:

a hand-operable base;

a tape guide device for guiding the double-faced adhesive tape that is successively supplied to the base;

a joining head for pressing against the joining face of the workpiece the double-faced adhesive tape guided to a front end of the base; and a tape cutting mechanism on the base for forming slits on sides of the separator at given intervals along a longitudinal tape direction, wherein the tape cutting mechanism comprises;

an arm pivotally connected to the base as to swing downward;

a rotary cutter operating from a separator side of the double-faced adhesive tape; and a holding roller for holding the double-faced adhesive tape from an adhesive face side thereof, and wherein the base and the joining head are configured to relatively rotate about a support shaft along the longitudinal tape direction.

2. The double-faced adhesive tape joining apparatus according to claim further comprising:

an elastic: bias device for elastically holding a relative rotation attitude of the base the joining head.

3. The double-faced adhesive tape joining apparatus according to claim wherein the tape cutting mechanism switches back and forth between an operating condition where the rotary cutter and the holding roller are placed close to form a slit on sides of the separator of the double-faced adhesive tape passing between the rotary cutter and the holding roller and a non-operating condition where the rotary cutter is spaced away from the holding roller and the double-faced adhesive tape travels while no slit is formed.

4. The double-faced adhesive tape joining apparatus according to claim 3, further comprising: an elastic body for swingingly biasing the arm upward relative to the base.

5. The double-faced adhesive tape joining apparatus according to claim 4, further comprising:

a holding mechanism for fixedly holding the arm on the base such that the rotary cutter at a lower portion of the arm is fixed in an operation position when the arm moves downward against swinging bias.

6. The double-faced adhesive tape joining apparatus according to claim 1, wherein the joining head includes as roller supported on the front end of the base as to freely rotate.

7. The double-faced adhesive tape joining apparatus according to claim 1, wherein the joining head includes as tape guide groove having a smaller thickness and as larger width than the double-faced adhesive tape that is formed on a planar lower surface of a block.

8. The double-faced adhesive tape joining apparatus according to claim 2, wherein the joining head includes a roller supported on the front end of the base as to freely rotate.

9. The double-faced adhesive tape joining apparatus according to claim 3, wherein the joining head includes a roller supported on the front end of the base as to freely rotate.

10. The double-faced adhesive tape joining apparatus according to claim 4, wherein the joining head includes a roller supported on the front end of the base as to freely rotate.

11. The double-faced adhesive tape joining apparatus according to claim 5, wherein the joining head includes a roller supported on the front end of the base as to freely rotate.

12. The double-faced adhesive tape joining apparatus according to claim 2, wherein the joining head includes a tape guide groove having a smaller thickness and a larger width than the double-faced adhesive tape that is formed on a planar lower surface of a block.

13. The double-faced adhesive tape joining apparatus according to claim 3, wherein the joining head includes a tape guide groove having a smaller thickness and a larger width than the double-faced adhesive tape that is formed on a planar lower surface of a block.

14. The double-faced adhesive tape joining apparatus according to claim 4, wherein the joining head includes a tape guide groove having a smaller thickness and a larger width than the double-faced adhesive tape that is formed on a planar lower surface of a block.

15. The double-faced adhesive tape joining apparatus according to claim 5, wherein the joining head includes a tape guide groove having a smaller thickness and a larger width than the double-faced adhesive tape that is formed on a planar lower surface of a block.

* * * * *